United States Patent [19]

Braverman et al.

[11] Patent Number: 4,881,336

[45] Date of Patent: Nov. 21, 1989

[54] DISPLAY DEVICE

[75] Inventors: Melvin Braverman; Joseph Lazar, both of Westbury, N.Y.

[73] Assignee: Jefferson International, Westbury, N.Y.

[21] Appl. No.: 202,718

[22] Filed: Jun. 3, 1988

[51] Int. Cl.[4] ..... G09F 19/00

[52] U.S. Cl. ..... 40/530

[58] Field of Search ..... 40/530, 535, 536, 379, 40/119, 121, 120; 211/54.1, 45, 53, 57.1, 58, 59.1; 206/554; 402/21, 45, 56

[56] References Cited

U.S. PATENT DOCUMENTS

| | | | |
|---|---|---|---|
| 570,667 | 11/1896 | Johnson | 40/121 |
| 588,631 | 8/1897 | Brown | 211/57.1 |
| 629,864 | 8/1899 | Maloney | 40/120 |
| 967,893 | 8/1910 | Ehmling | 40/120 |
| 1,754,327 | 4/1930 | Leonard | 211/53 |
| 1,885,129 | 11/1932 | Morris | 40/120 |
| 4,399,626 | 8/1983 | Baverman et al. | 40/530 |

FOREIGN PATENT DOCUMENTS

| | | | |
|---|---|---|---|
| 374048 | 4/1907 | France | 40/119 |

*Primary Examiner*—Robert Peshock
*Assistant Examiner*—Cary E. Stone
*Attorney, Agent, or Firm*—Bauer & Schaffer

[57] ABSTRACT

A display device including a base, to which an upright standard is mounted. A display frame is rotatably mounted on the upright standard to permit rotation of the display frame about a vertical axis. Display support rods are mounted on the display frame for holding multiple groups of display items, such as photographs and the like. By rotation of the display frame, a selected group of the display items may be brought to view. The display support rods are constructed to be removeably inserted in holes in the dependent sheet so as to extend cantilevered therefrom, to permit selected display items to be flipped upwardly to expose the reverse side of the display item being flipped upwardly as well as the front side of the display item next behind the display item being flipped upwardly.

2 Claims, 1 Drawing Sheet

Fig. 1
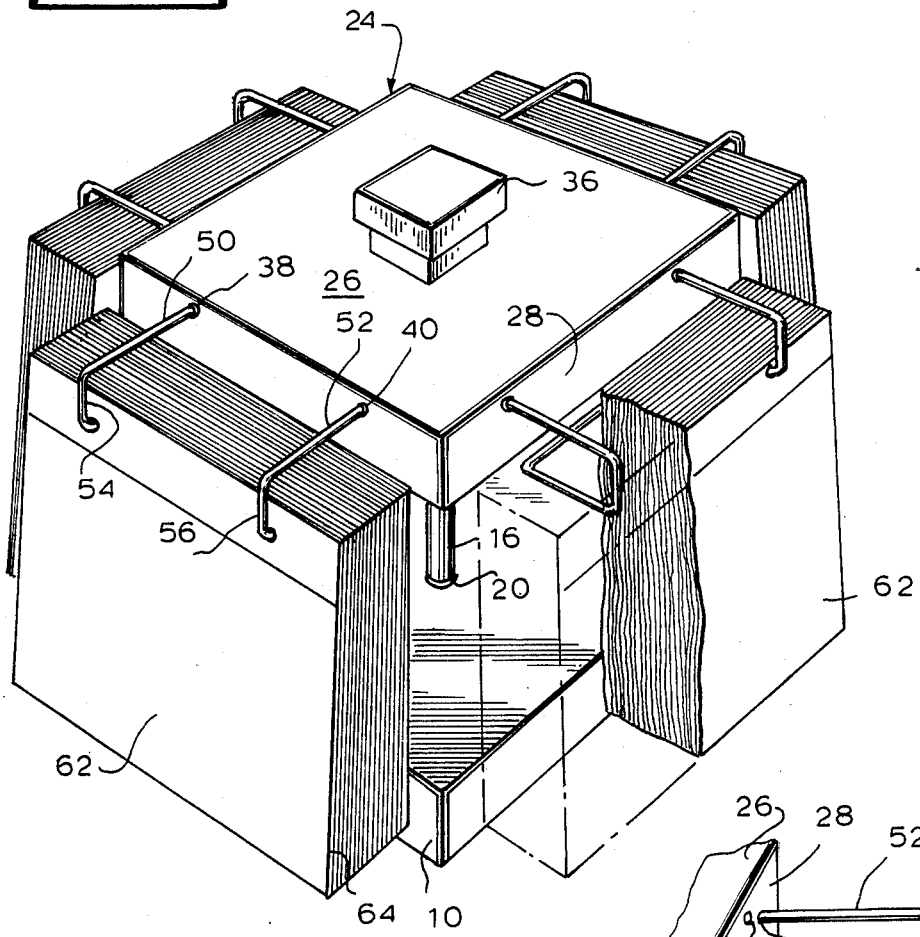
Fig. 2
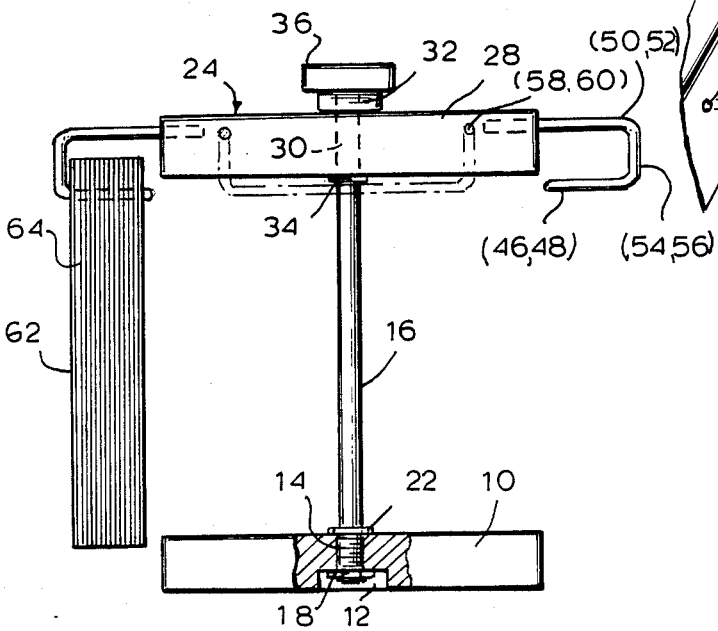
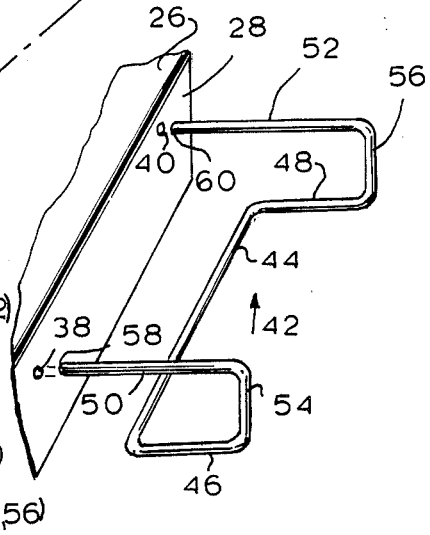
Fig. 3

DISPLAY DEVICE

The present invention relates to display devices. More particularly, the invention relates to an improved display device which, although useful for display of a wide variety of items such as cards, booklets and the like, as well as general items of merchandise of appropriate size and packaging, is especially useful displaying photographs and the like.

BACKGROUND OF THE INVENTION

Our earlier U. S. Pat. No. 4,399,626 dated Aug. 23, 1983 shows a display device which includes a base having a box like enclosure in which is rotatably mounted an upright standard. A cover if fixed to the box and the vertical standard and display support rods are fixedly mounted between the cover and the box holding multiple groups of display items, such as photographs and the like. The display support rods are also inserted into receiving slots in the walls of the box. While our prior patented device presents a distinct improvement over the devices briefly described above, and is satisfactory for its inventive purpose, there still exists a need for such a device which exhibits the advantages thereof, but which is of simple construction, thus being not only easier to manufacture and assemble, but also simpler to use, especially with regard to disposing of and removing display items from the support rods.

The present invention fulfills such a need by providing a device in which the display rods are cantilevered from the top of the frame and are easily removable and replaced without the need to completely disassemble the device.

BRIEF STATEMENT OF THE INVENTION

In accordance with the present invention, there is provided a display device for displaying selected items comprising a base; an upright standard mounted on and supported by the base; and a display frame including a top member having abbreviated, dependent skirt extending around the periphery thereof. The top member is rotatably mounted on the upright standard, near the upper end thereof in a spaced relationship with respect to the base. Product support rod means for supporting the selected items to be displayed, are removably attached to the top member. The support rod means includes one or more generally "U" shaped member with a pair of opposing legs and an intermediate connecting leg. The opposing legs of each support rod means are inserted in receiving holes formed in a corresponding section of the abbreviated, dependent skirt, such that the connecting leg of the "U" shaped member extends away from the top member and the intermediate leg is disposed in spaced apart relation from the dependent skirt to which the support rod means is mounted.

THE DRAWINGS

In order that the present invention may be clearly understood and readily carried out, a preferred embodiment thereof is described below, by way of example only, with reference to the accompanying drawings wherein:

FIG. 1 is a view in perspective of an improved display device according to the invention;

FIG. 2 is a partial view in elevation of the device illustrated in FIG. 1 showing the disposition of the upright standard, the base and the display frame with respect to each other; and FIG. 3 is a partial view of an abbreviated, dependent skirt illustrating how the support rod means is attached thereto.

DESCRIPTION OF THE PREFERRED EMBODIMENTS

Referring now to FIGS. 1 and 2, the improved display device according to the present invention comprises a base 10 which is made of a solid generally rectangular piece of material which may be wood, plastic or other suitable material.

Base 10 is provided substantially at its center with an inset opening 12 in its bottom joining a through-channel or bore 14. An upright standard 16 thread at its bottom end is disposed in bore 14 and fixed in place with a lock-nut 18 located in inset opening 12. A retaining ring or circular guide 20 is disposed on standard 16 and rests on the upper surface of base 10.

A display frame generally depicted by the numeral 24 is provided with a flat top member 26 of similar over-all size to the base 10. The top member may be solid, hollow or open in its bottom, but in any event has an abbreviated, dependent skirt 28 about its entire periphery. The top member 26 is provided with centrally located bore 30 so as to be rotatably mounted on the upper end 32 of the upright standard 16 and rotatably supported on a retaining ring or circular guide 34 fixedly disposed on standard 16. The upper end of standard 16 is also threaded, like the lower end and a decorative nut or cap 36 is disposed thereon to secure the display frame 24 to upright standard 16 from axially dislodgement.

The dependent skirt 28 is provided with paired openings 38 and 40 and display item support means, such as display item support rods generally depicted by the numeral 42-mounted thereon by fixing the ends of the rods in the openings. In the embodiment shown, the top member 24 is illustrated as being square, so that the periphery has four sides, each side having one pair of openings 38 and 40. It will be apparent that the top member 24 may be configured otherwise as desired, i.e., as a five, six, eight or other polygonal figure and that more than two pair of holes 38 and 40 can be employed.

The free ends 58 and 60 of the extensions 50 and 52 are spaced apart laterally by the distance between holes 38 and 40 and are insertable freely in these holes. They are held in the holes by a combination of the depth of insertion and the inherent spring action of the legs 50 and 52. As may be seen from FIG. 3 a support rod 42 includes a generally "U" shaped portion 44 with opposing legs 46 and 48. The legs 46 and 48 extend outwardly from the "U" shaped portion 44 providing extensions 50 and 52 which are bent and twisted upward forming intermediate perpendicular sections 54 and 56 so that the opposing extension legs 50 and 52 lie directly above and parallel to legs 46 and 48 respectively, all lying cantilevered from the top member in a generally horizontal plane with respect to the display frame. It is to be noted, therefore, that when support rod 42 is mounted on display frame 24, the "U" shaped portion 44 is spaced in a horizontal disposition below and away from the skirt 28 of the display frame and the intermediate sections 54 and 56 are disposed in a spaced apart relation with respect to skirt 28. The display items may be mounted on each support rod 42 separately so as to be slidable on and be in depending relation to the frame. For example, the display items may be glassine envelopes 62 as shown in FIGS. 1 and 2. Photographs may be inserted in such envelopes in a back to back relation. The envelopes 62 are provided with openings 64 which are made along one edge thereof for receiving the support rods. The envelopes hang in depending relation from the opposing legs of the support rod to expose for view the front panel of an envelope. This envelope 62 may be flipped upwardly to expose both the photograph inserted adjacent the rear panel of the envelope being flipped upwardly and the photograph inserted adjacent the frame panel of the envelope next behind the envelope being flipped upwardly.

The present invention provides an improved versatile carousel type display device where a user can rotate the display frame about a vertical axis to bring into viewing position, a selected group of items to be viewed. The user may then flip through the group of items to view the selected item of interest. With items such as photographs held in envelopes, this display device enables a user to display many photographs in little space. Moreover, the photographs may be arranged on the display frame in any desirable sequence. Furthermore, the photographs are protected from damage yet available for instant viewing.

A feature of the present invention lies in the attachment of the supporting rod directly to the top member of the frame assembly so that it may be easily removed and replaced without detaching the top member from the base or the central supporting standard. Thus, the envelopes may be easily replaced without dismantling the entire device.

The foregoing structure also permits photographs or other items to be mounted without the use of glassine envelopes or the like, by simple providing the edge of the photo with holes through which legs 50 and 52 can be inserted.

While the fundamental novel features of the present invention have been shown and described, it is to be understood that various substitutions, modifications and variations may be made by those skilled in the art without departing from the spirit and scope of the invention.

Accordingly, all such modifications and variations are included in the scope of the invention as defined in the appended claims.

What is claimed is:

1. An improved display device for displaying selected items comprising:

a base;

an upright standard fixedly mounted by its lower end on said base;

a unitary frame including a polygonal top member having an integral dependent skirt extending around the periphery thereof, means for rotatably fastening said unitary frame on the upper end of said standard, spaced from said base and at least one pair of holes in said depending skirt extending inwardly of said top member parallel to said base;

bent spring rod means for supporting the selected items to be displayed, said rod means having a generally "U" shaped portion with opposing legs, an intermediate leg extending perpendicular from each of the opposing legs, and an arm extending freely from each of the intermediate legs in parallel to the associated one of said opposing legs, said arms being removably received in respective ones of a pair of spaced holes in said integral dependent skirt such that the "U" shaped portion is disposed freely in the space between said base and said integral dependent skirt, said rod means being removable from said holes to permit said items to be placed on or removed therefrom.

2. The improved display device according to claim 1, wherein the fastening means comprises a threaded end on the upper portion of the upright standard and a nut threaded thereon to secure the top member of the display frame thereon.

* * * * *